US005904637A

United States Patent [19]

Kuo

[11] Patent Number: 5,904,637

[45] Date of Patent: May 18, 1999

[54] FOLDING COLLAPSIBLE JOGGING EXERCISER

[76] Inventor: Johnson Kuo, 5F., No. 6, Lane 12, Sec. 6, Hsin I Rd., Taipei, Taiwan

[21] Appl. No.: 09/090,264

[22] Filed: Jun. 4, 1998

[51] Int. Cl.[6] ..... A63B 22/02

[52] U.S. Cl. ..... 482/54

[58] Field of Search ..... 482/51, 54

[56] References Cited

U.S. PATENT DOCUMENTS

| | | | |
|---|---|---|---|
| 931,394 | 8/1909 | Day | 482/54 |
| 4,679,787 | 7/1987 | Guilbault | 482/54 |
| 4,757,987 | 7/1988 | Allemand | 482/54 |
| 5,702,325 | 12/1997 | Watterson et al. | 482/54 |
| 5,833,577 | 11/1998 | Hurt | 482/54 |

*Primary Examiner*—Glenn E. Richman
*Attorney, Agent, or Firm*—Varndell Legal Group

[57] ABSTRACT

A folding collapsible jogging exerciser includes a bottom frame, two upright supports and two handlebars raised from the bottom frame, a top frame fastened to the upright supports and coupled to the handlebars, and a rack having one end pivoted to the upright supports on which the user jogs, wherein a stand is pivoted to the rack and turned to support the free end of the rack on the floor between two tilted positions; one upright support has a lug for securing the rack in a collpased position; the bottom frame has a U-shaped frame bar, two movable frame bars hinged to the U-shaped frame bar, and a connecting frame bar detachably connected to the movable frame bars by screws to secure the bottom frame between an extended position and a collapsed position, the connecting frame bar being equipped with wheels, that make the jogging exercise easy to move.

1 Claim, 9 Drawing Sheets

FOLDING COLLAPSIBLE JOGGING EXERCISER

BACKGROUND AND SUMMARY OF THE INVENTION

The present invention relates to a jogging exerciser, and more particularly to a folding collapsible jogging exerciser.

Various jogging exercisers have been disclosed, and have appeared on the market. These conventional jogging exercisers are functional. However, because these conventional jogging exercisers are heavy and not collapsible, they can not be conveniently moved from place to place, or transported from the warehouse to the distributors or end users.

It is one object of the present invention to provide a jogging exerciser which is folding collapsible. It is another object of the present invention to provide a jogging exerciser which can be conveniently moved from place to place. According to one aspect of the present invention, the folding collapsible jogging exerciser is comprised of a base frame, two upright supports and two handlebars raised from the base frame. A top frame fastened to the upright supports and coupled to the handlebars, a rack having one end pivoted to the upright supports on which the user jogs, and a stand pivoted to the rack and turned to support the free end of the rack on the floor between two tilted positions, wherein one upright support has a lug for securing the rack in a collapsed position. According to another aspect of the present invention, the bottom frame comprises a U-shaped frame bar, two movable frame bars hinged to the U-shaped frame bar, and a connecting frame bar detachably connected to the movable frame bars by screws to secure the bottom frame between an extended position and a collapsed position, the connecting frame bar being equipped with wheels, that make the jogging exercise easy to move.

DETAILED DESCRIPTION OF THE PREFERRED EMBODIMENT

Figure 1:
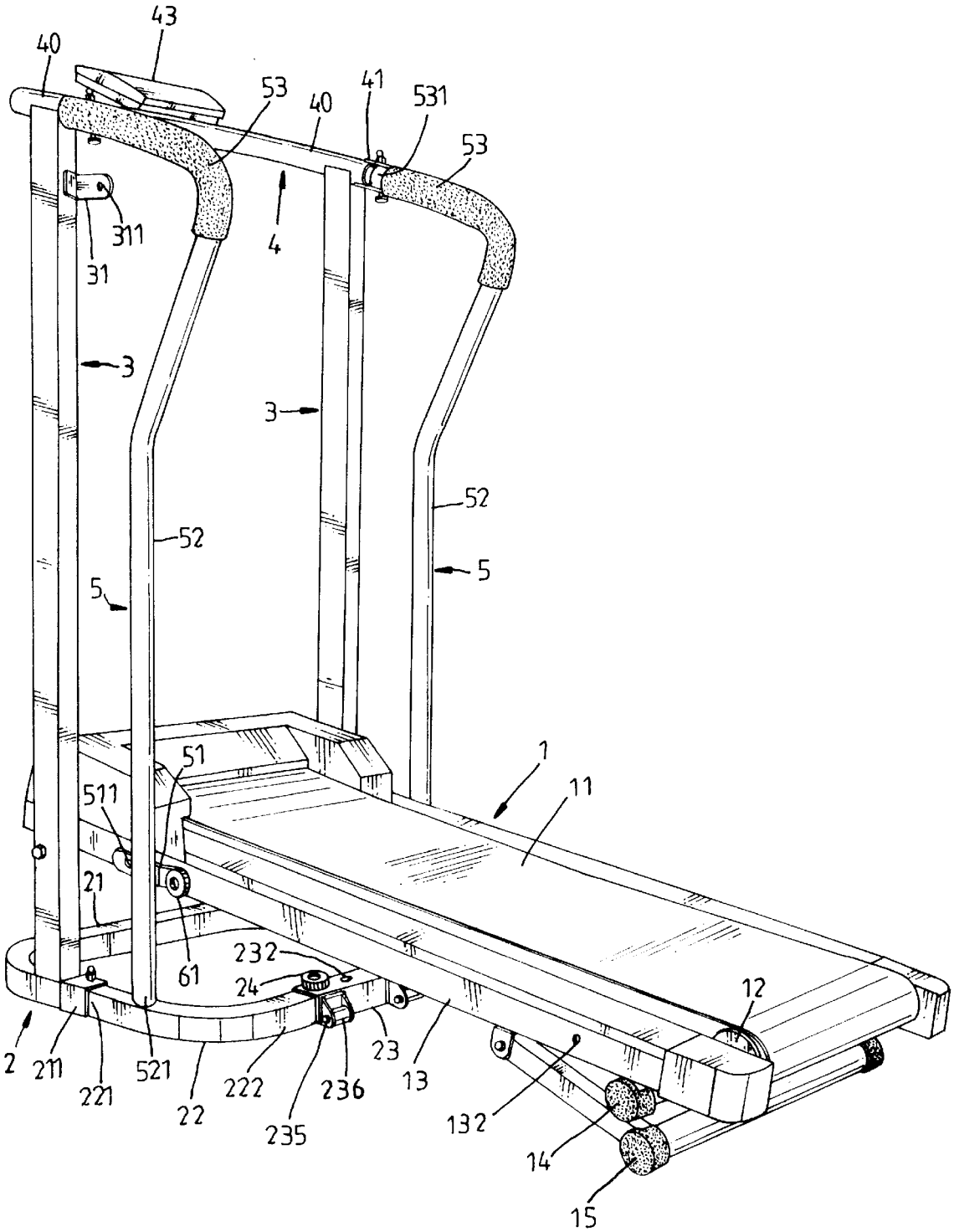
FIG. 1 is a perspective of a folding collapsible jogging exerciser according to the present invention.

Referring to FIGS. from 1 to 9, a jogging exerciser in accordance with the present invention is generally comprised of a rack 1, a bottom frame 2, two upright supports 3, a top frame 4, and two handlebars 5.

Figure 2:
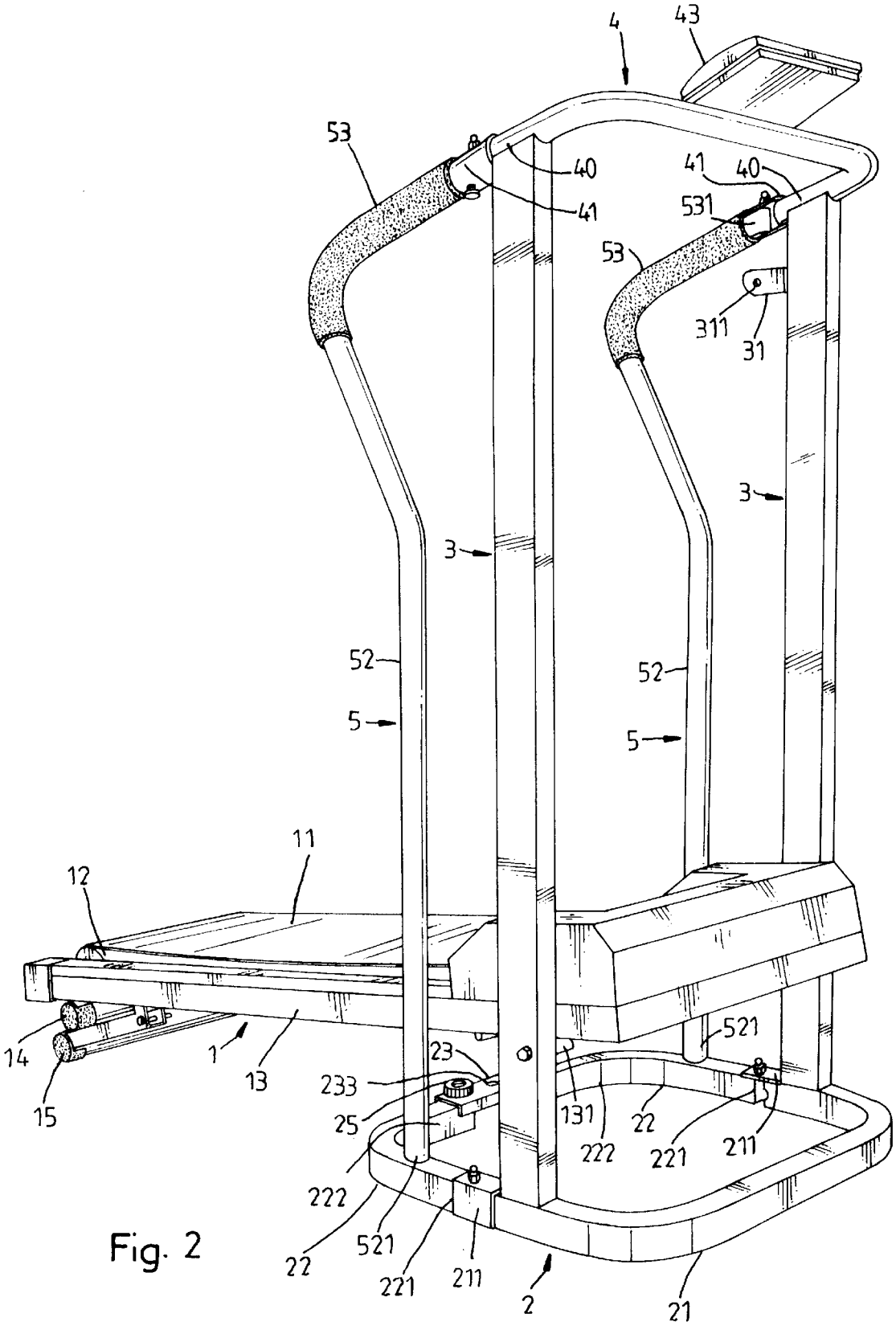
FIG. 2 is another perspective view of the folding collapsible jogging exerciser viewed from another angle according to the present invention.

The bottom frame 2 is a rectangular open frame supported on the floor to hold the upright supports 3 (see FIGS. 1 and 2).

The upright supports 3 are bilaterally raised from the bottom frame 2 to hold the top frame 4 (see FIGS. 1 and 2).

The top frame 4 is a substantially U-shaped frame holding an instrument panel 43, and having two opposite coupling portions 40 respectively fixedly fastened to the upright supports 3 at the top (see FIGS. 1 and 2).

Figure 3:
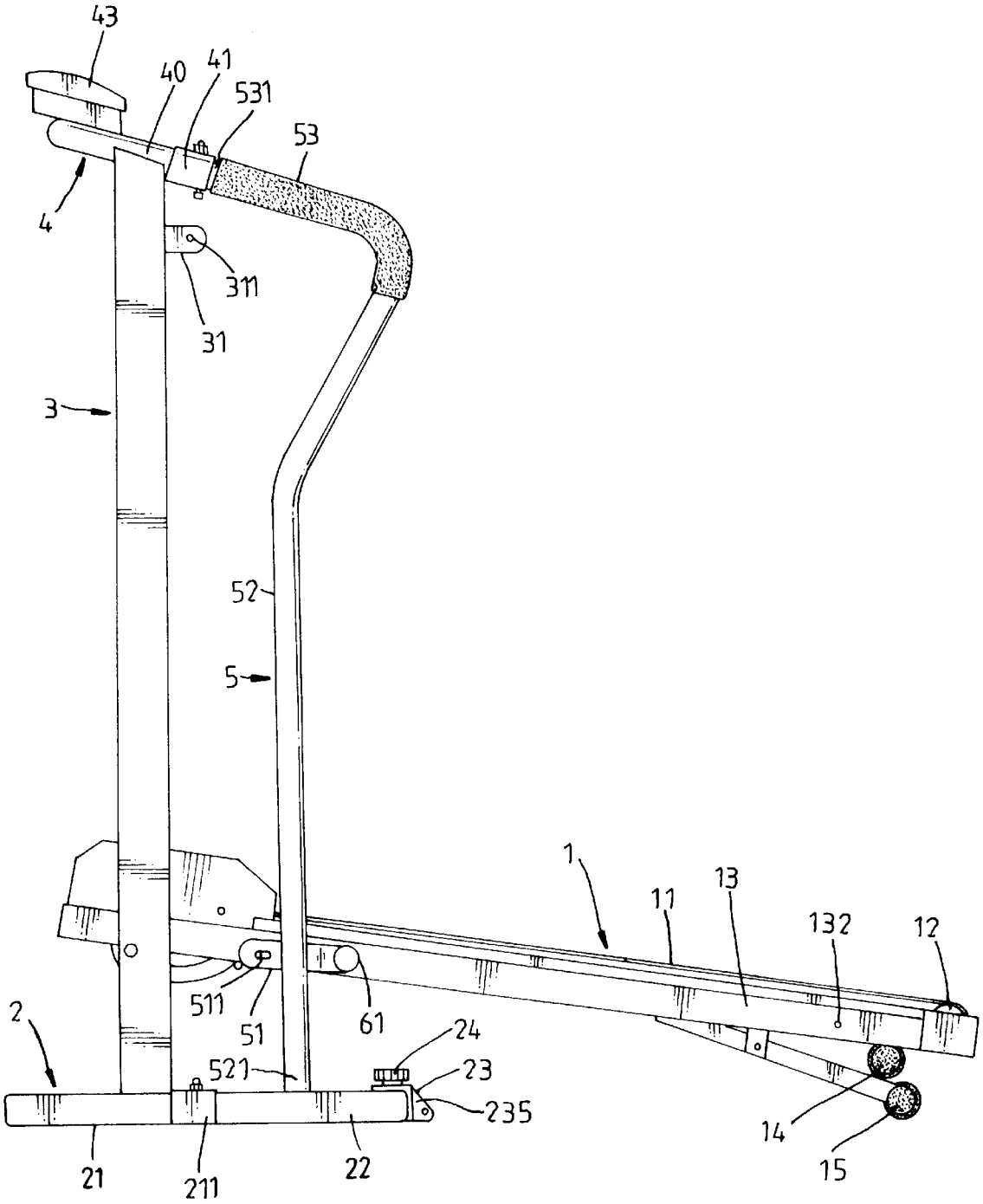
FIG. 3 is a side plain view of the folding collapsible jogging exerciser according to the present invention, showing the stand moved away from the bottom cross bar.
Figure 7:
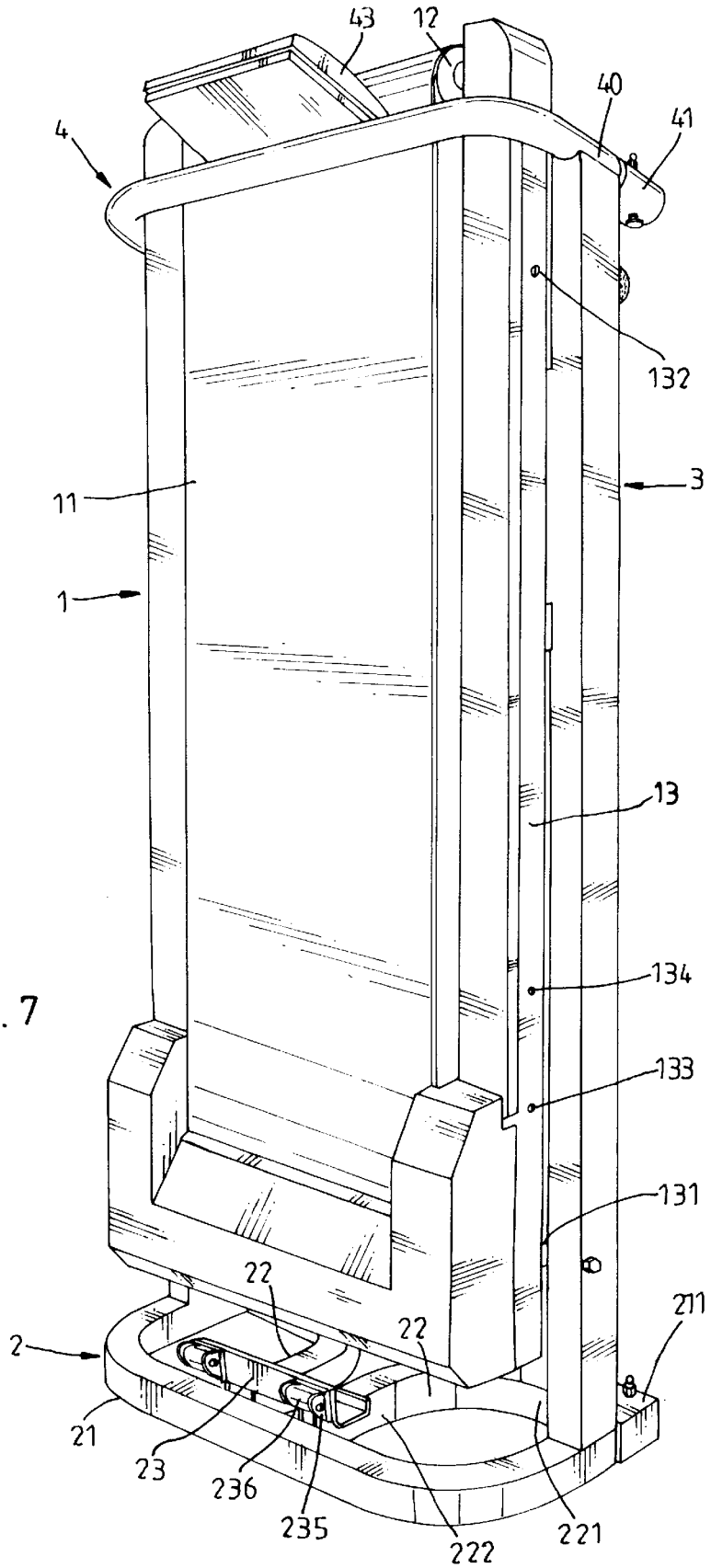
FIG. 7 shows the rack turned upwards and attached to the upright supports and the bottom frame collapsed according to the present invention.

The rack 1 comprises two longitudinal rails 13 arranged in parallel, the longitudinal rails 13 each having one end respectively pivoted to the upright supports 3 by a respective pivot pin 131, a plurality of parallel rollers 12 revolvably supported between the longitudinal rails 13, an endless belt 11 covered around the rollers 12 on which the user jogs, a bottom cross bar 14 at one end remote from the pivot pins 131, and a stand 15 pivoted to the longitudinal rails 13 at the bottom side and disposed adjacent to the bottom cross bar 14 (see FIG. 2). One longitudinal rail 13 has two longitudinal spaced locating holes 133; 134 selectively connected to a locating plate 51 at one handlebar 5 by a screw 61 (see FIGS. 3, 4 and 7). The stand 15 can be turned forwards or backwards to support the rack 1 on the floor between two tilted positions (see FIGS. 3 and 4).

The handlebar 5 are arranged in parallel. One handlebar 5 has a fixed locating plate 51 near a bottom end thereof. The locating plate 51 has two locating holes 511; 512 at two opposite ends selectively fastened to one locating hole 133 or 134 on one longitudinal rail 13 of the rack 1 (see FIGS. 3, 4 and 5).

Figure 4:
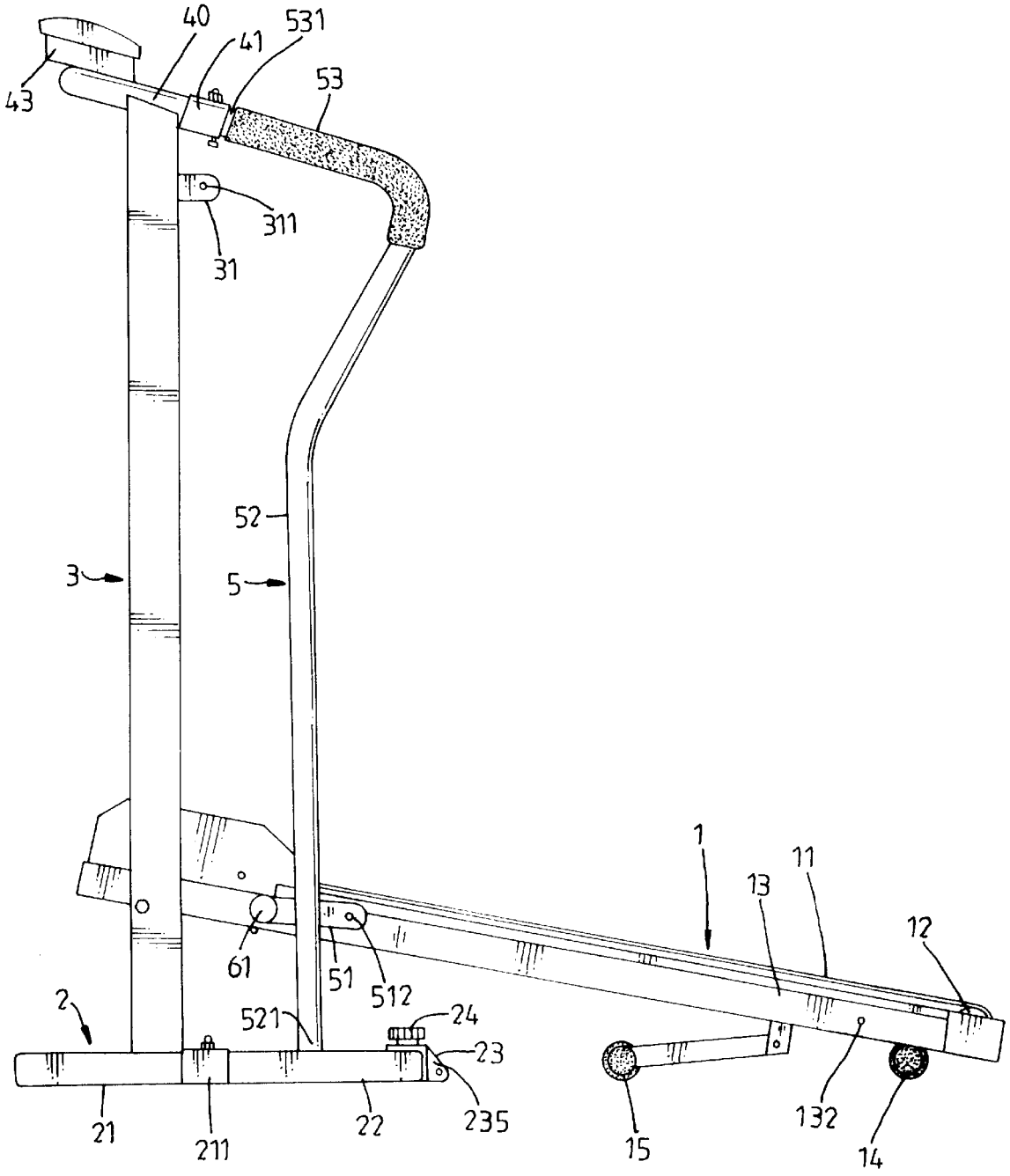
FIG. 4 is another side plain view of the folding collapsible jogging exerciser according to the present invention, showing the bottom cross bar of the rack supported on the stand.
Figure 5:
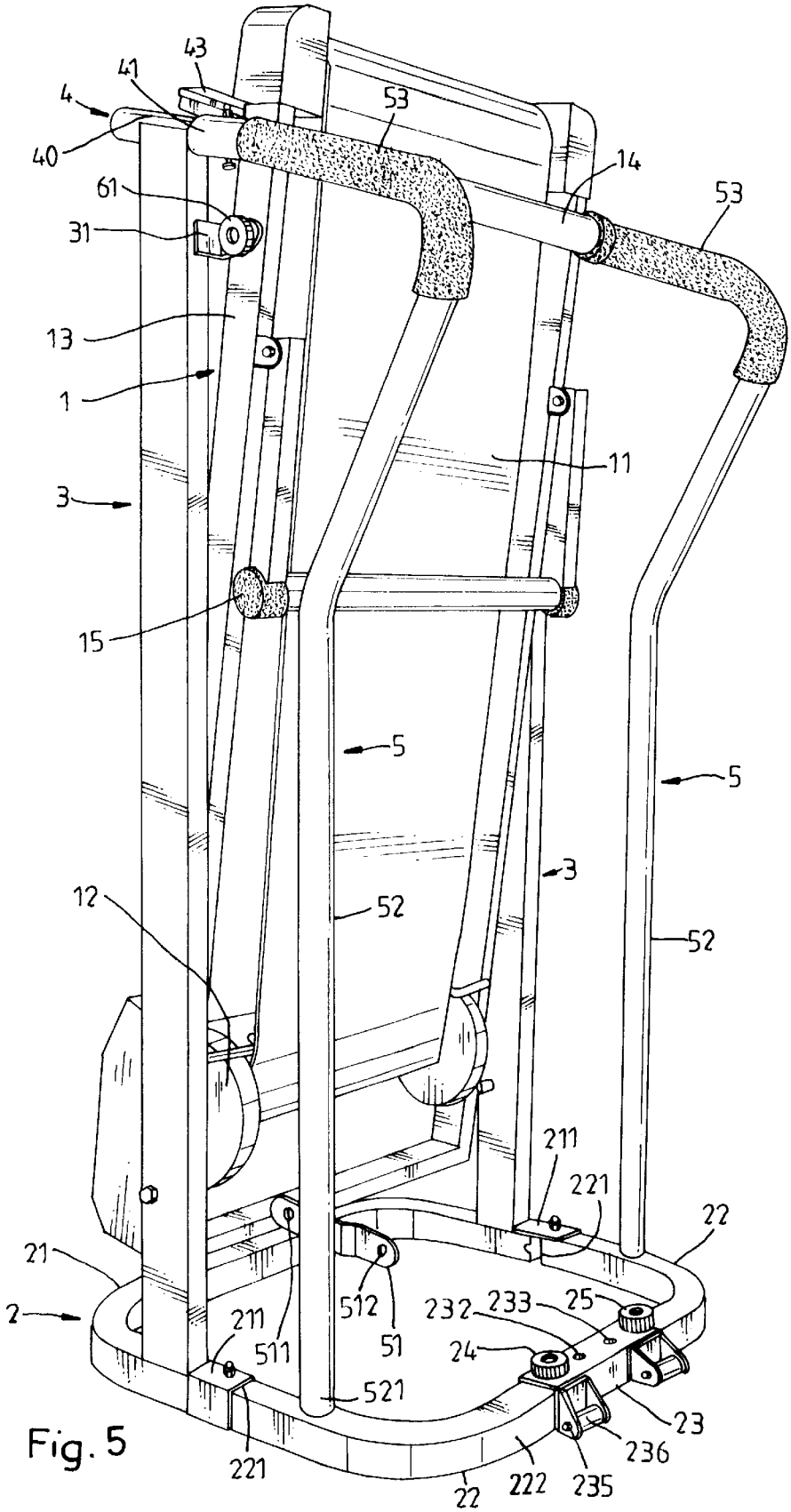
FIG. 5 shows the folding collapsible jogging exerciser collapsed according to the present invention.

When the stand 15 is turned to the first position shown in FIG. 4, the bottom cross bar 14 is directly placed on the floor to support the rack 1 in a first tilted position (see FIG. 4). When the stand 15 is turned to the second position shown in FIG. 3, the bottom cross bar 14 of the rack 1 is supported on te stand 15 above the floor, enabling the rack 1 to the supported in a second tilted position (see FIG. 3). The sloping angle of the rack 1 at the first tilted position is greater than at the second tilted position.

Figure 6:
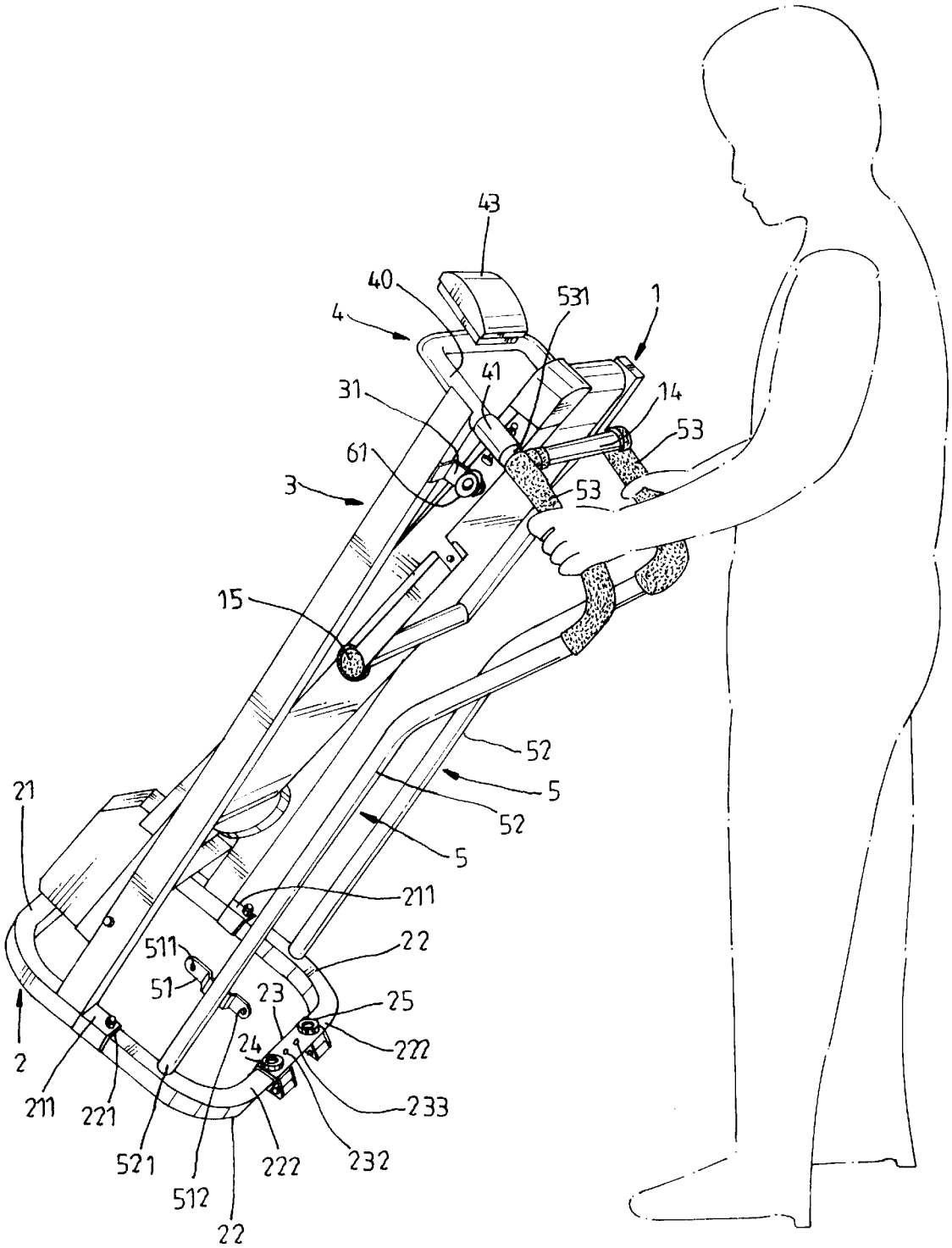
FIG. 6 shows the folding collapsible jogging exerciser collapsed, tilted, and moved according to the present invention.

The main characteristics of the present invention are outlined hereinafter. One longitudinal rail 13 of the rack 1 has a screw hole 132 at an outer side near the bottom cross bar 14 (see FIG. 3). One upright support 3 has a lug 31 near the top, which has a screw hole 311 (see FIG. 2). When not in use, the rack 1 is turned upwards and closely attached to the upright supports 3, permitting screw hole 132 on one longitudinal rail 13 to be fastened to the screw hole 311 on the lug 31 by a screw 61 (see FIGS. 4 and 5). The handlebars 5 each comprise a verical handlebar section 52 having a bottom end 521 fixedly fastened to the bottom frame 2, and a horizontal handlebar section 53 integral with the top end of the vertical handlebar section 52 and having a front end 531 connected to the top frame 4 (see FIGS. 1 and 2). The top frame 4 has two opposite ends 41 to which the front ends 531 of the horizontal handlebar sections 53 of the handlebars 5 are pivoted (see FIGS. 1 and 2). The bottom frame 2 comprises a substantially U-shaped frame bar 21 which holds the upright supports 3, two movable frame bars 22 which hold the handlebars 5 respectively, and a connecting frame bar 23 connected between the movable frame bars 22 (see FIGS. 1 and 2). The movable frame bars 22 each have a first end 221 respectively hinged to two opposite ends 211 of the U-shaped frame bar 21, and a second end 222 made with a screw hole 2221 (see FIG. 8). The connecting frame bar 23 comprises two first screw holes 231; 234, two second screw holes 233; 232 in line with and spaced between the first screw holes 231; 234, two wheel holders 235 at an outer side, and two wheels 23B respectively mounted on the wheel holders 235 (see FIG. 9). When the movable frame bars 22 are extended out, the first screw holes 231; 234 of the connecting frame bar 23 are respectively fastened to the screw holes 2221 on the second ends 222 of the movable frame bars 22 by screws 24; 25 (see FIG. 5). When the rack 1 is turned upwards and secured to the lugs 31 on one upright support 3, the jogging exerciser can then be tilted and supported on th wheel 236 and then conveniently moved on the floor (see FIG. 6).

Figure 8:
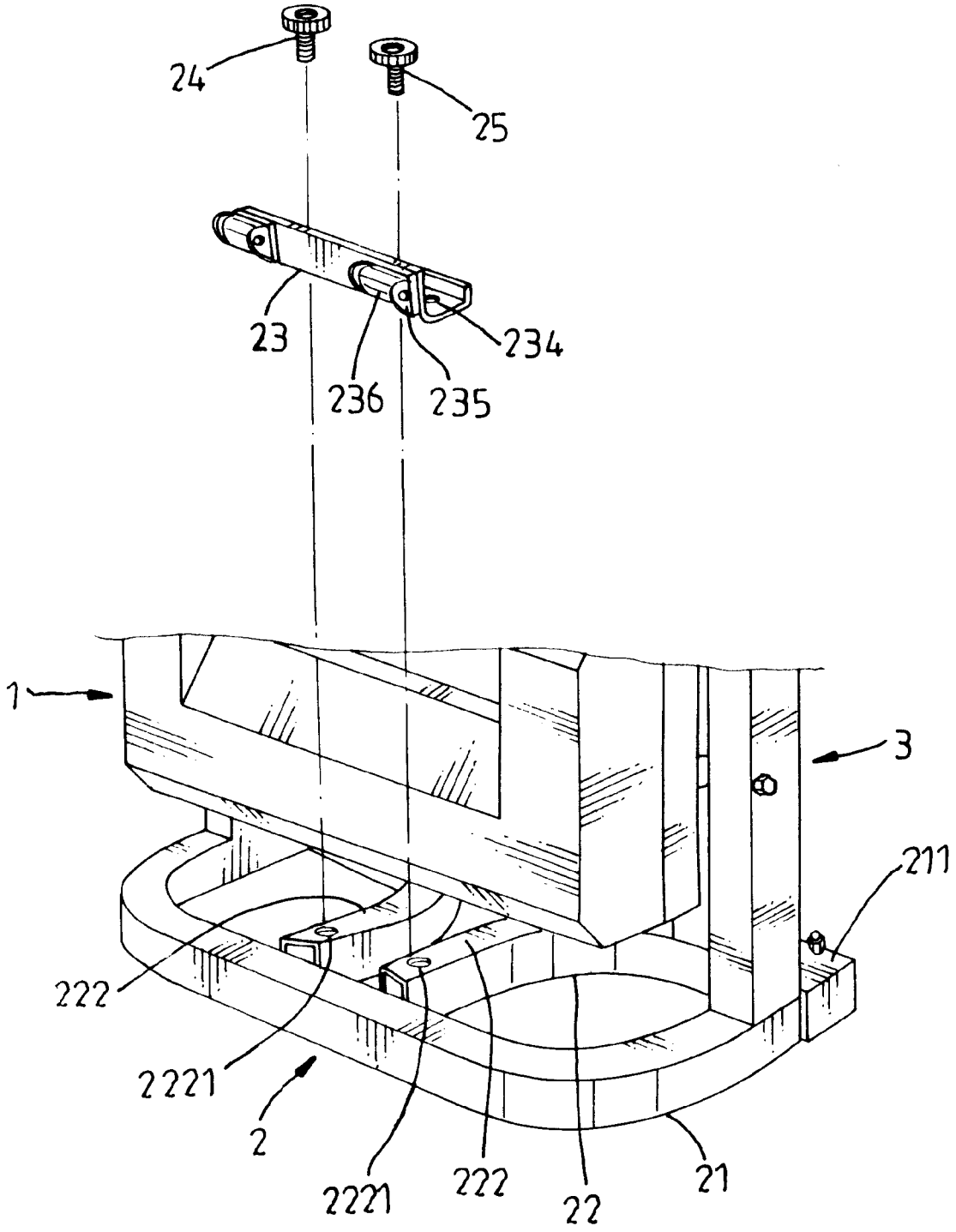
FIG. 8 is an exploded view of a part of the present invention, showing the connecting frame bar disconnected from the movable frame bar, the movable frame bars turned inwards and received within the U-shaped frame bar.
Figure 9:
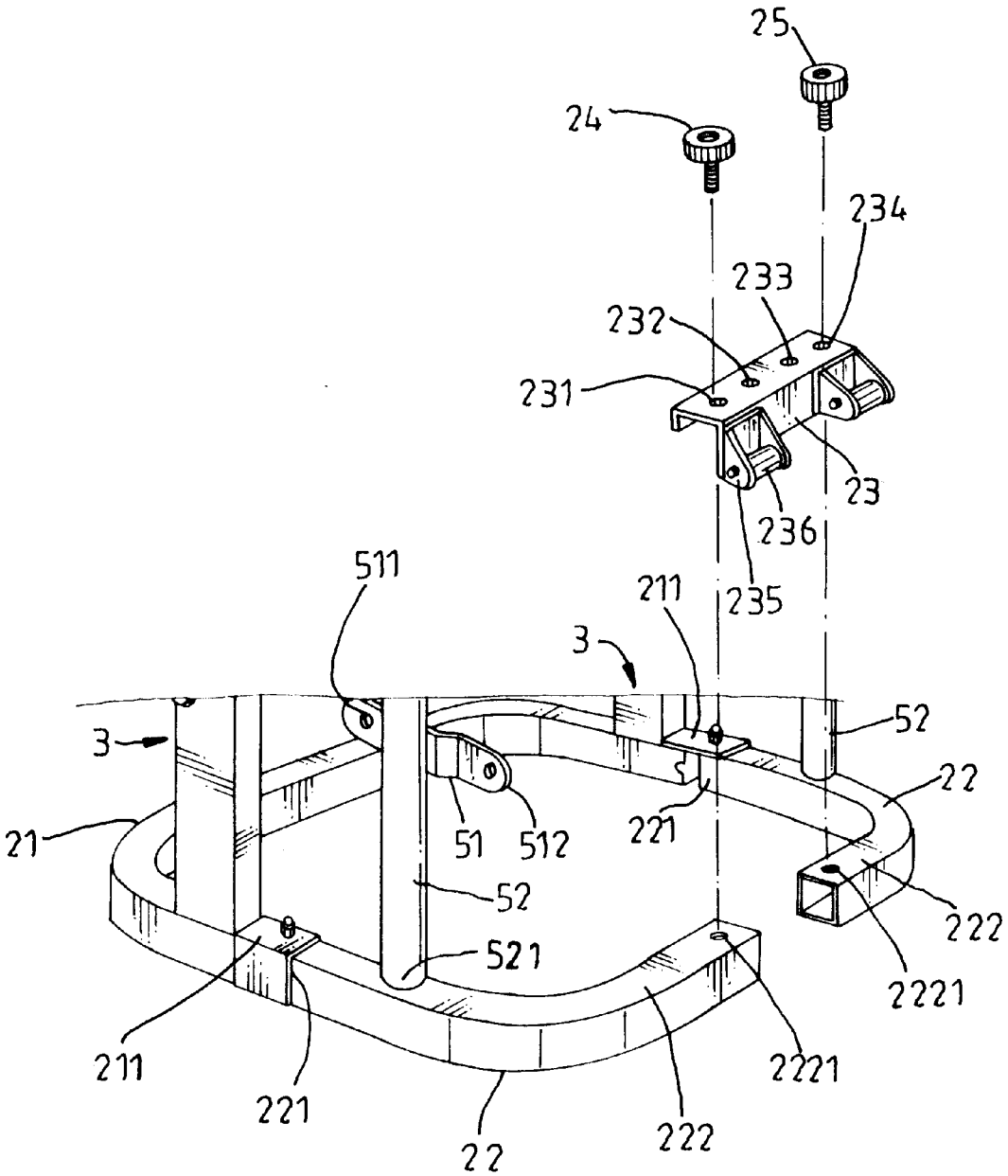
FIG. 9 is similar to FIG. 8 but showing the movable frame bars extended out.

Furthermore, when the screws 24; 25 are removed from the connecting frame bar 23, the connecting frame bar 23 can be disconnected from the movable frame bars 22, enabling the movable frame bars 22 to be turned inwards and received within the U-shaped frame bar 21 (see FIGS. 8 and 9). After the movable frame bars 22 have been turned inwards and received within the U-shaped frame bar 21, the screws 24; 25 are respectively threaded into the second screw holes 232; 233 on the connecting frame bar 23 and the screw holes 2221 on the second ends 222 of the movable frame bars 22 to secure the movable frame bars 22 in the collapsed position (see FIG. 7).

I claim:

1. A folding collapsible jogging exerciser comprising:

a bottom frame;

two upright supports each having a bottom end respectively connected to said bottom frame and a top end;

a substantially U-shaped top frame fixedly fastened the top ends of said upright supports;

two handlebars each having a bottom end connected to said bottom frame and a top end connected to said top frame; and a rack pivoted to said upright supports, said rack comprising two longitudinal rails arranged in parallel, said longitudinal rails each having a front end respectively pivoted to said upright supports, a rear end, a plurality of parallel rollers revolvably supported between said longitudinal rails, an endless belt covered around said rollers on which the user jogs, a bottom cross bar connected between the rear ends of said longitudinal rails at a bottom side, and a stand pivoted to said longitudinal rails and turned between a first position where the rear ends of said longitudinal rails are supported on the floor by said bottom cross bar, and a second position where the rear ends of said longitudinal rails are supported on the floor by said stand, one of said longitudinal rail having two longitudinally spaced locating holes selectively connected to a locating plate at one handlebar by a screw;

wherein:

one of said upright supports has a lug and a screw hole on the lug;

one of said longitudinal rails of said rack has a screw hole at an outer side near said bottom cross bar for connection to the screw hole on the lug at one of said upright supports by a screw when said rack is turned upwards and closely attached to said upright supports;

said handlebars each comprise a vertical handlebar section having a bottom end fixedly fastened to said bottom frame and a top end, and a horizontal handlebar section having a rear end integral with the top end of said vertical handlebar section and a front end pivoted to said top frame;

said top frame has two opposite ends respectively connected to the front ends of the horizontal handlebar sections of said handlebars;

said bottom frame comprises a substantially U-shaped frame bar which holds said upright supports, two movable frame bars which hold said handlebars respectively, and a connecting frame bar connected between said movable frame bars, said movable frame bars each having a first end respectively hinged to two opposite ends of said U-shaped frame bar and a second end made with a screw hole, said movable frame bars being turned relative to said U-shaped frame bar between an extended position and a collapsed position, said connecting frame bar comprising two first screw holes which are respectively fastened to the screw holes on said movable frame bars by screws when said movable frame bars are turned to said extended position, two second screw holes arranged in line with and spaced between said first screw holes which are respectively fastened to the screw holes on said movable frame bars when by screws when said movable frame bars are turned to said collapsed position, two wheel holders disposed at an outer side, and two wheels respectively mounted on said wheel holders.

* * * * *